US011639571B2

(12) United States Patent
Hettinger et al.

(10) Patent No.: US 11,639,571 B2
(45) Date of Patent: May 2, 2023

(54) SYSTEM AND METHOD FOR DETERMINING DRY LOAD WEIGHT WITHIN A WASHING MACHINE APPLIANCE

(71) Applicant: Haier US Appliance Solutions, Inc., Wilmington, DE (US)

(72) Inventors: Stephen Edward Hettinger, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 457 days.

(21) Appl. No.: 16/832,243

(22) Filed: Mar. 27, 2020

(65) Prior Publication Data

US 2021/0301444 A1 Sep. 30, 2021

(51) Int. Cl.

| | |
|---|---|
| ***D06F 33/36*** | (2020.01) |
| ***D06F 34/18*** | (2020.01) |
| *D06F 33/44* | (2020.01) |
| *D06F 33/37* | (2020.01) |

(52) U.S. Cl.

CPC ..... *D06F 33/36* (2020.02); *D06F 34/18* (2020.02); *D06F 33/37* (2020.02); *D06F 33/44* (2020.02)

(58) Field of Classification Search

CPC ..... D06F 34/18

See application file for complete search history.

(56) References Cited

U.S. PATENT DOCUMENTS

| | | | |
|---|---|---|---|
| 4,987,627 | A | 1/1991 | Cur et al. |
| 5,577,283 | A | 11/1996 | Badami et al. |
| 5,619,614 | A | 4/1997 | Payne et al. |
| 6,374,444 | B2 | 4/2002 | Skrippek et al. |
| 6,842,928 | B2 | 1/2005 | Yang et al. |
| 7,162,759 | B2 | 1/2007 | Weinmann |
| 7,484,258 | B2 | 2/2009 | Kim et al. |
| 7,739,764 | B2 | 6/2010 | Zhang et al. |
| 7,930,786 | B2 | 4/2011 | La Belle et al. |
| 7,958,584 | B2 | 6/2011 | Suel, II et al. |
| 7,958,585 | B2 | 6/2011 | Zhang et al. |
| 8,505,139 | B2 | 8/2013 | Vanhazebrouck et al. |
| 9,206,538 | B2 | 12/2015 | Suel, II |
| 9,410,280 | B2 | 8/2016 | Hettinger |

(Continued)

FOREIGN PATENT DOCUMENTS

| | | |
|---|---|---|
| BR | PI0902470 A2 | 4/2010 |
| BR | PI0904273 A2 | 9/2010 |

(Continued)

*Primary Examiner* — Joseph L. Perrin
*Assistant Examiner* — Kevin G Lee
(74) *Attorney, Agent, or Firm* — Dority & Manning, P.A.

(57) ABSTRACT

A washing machine appliance includes a wash tub defining a wash chamber, a wash basket rotatably mounted within the wash tub, and a motor operably coupled to the wash basket for selectively rotating the wash basket. A controller is configured for accelerating the wash basket to a predetermined speed during an acceleration period and maintaining that speed during a steady state period. The controller further determines a power drop from the maximum power required to accelerate the wash basket to the power required to maintain the predetermined speed, and the dry load weight is calculated using this power drop and a transfer function.

18 Claims, 4 Drawing Sheets

(56) References Cited

U.S. PATENT DOCUMENTS

| | | | | |
|---|---|---|---|---|
| 9,840,805 | B2 | 12/2017 | Leonard et al. | |
| 2007/0266504 | A1 | 11/2007 | Xie et al. | |
| 2009/0112513 | A1 | 4/2009 | Filippa | |
| 2009/0205377 | A1* | 8/2009 | Suel, II | D06F 34/18 68/12.04 |
| 2015/0113739 | A1 | 4/2015 | Pollett et al. | |
| 2019/0055689 | A1* | 2/2019 | Pesavento | D06F 34/18 |
| 2019/0120725 | A1 | 4/2019 | Yoon et al. | |
| 2020/0102686 | A1* | 4/2020 | Kanagawa | D06F 23/04 |

FOREIGN PATENT DOCUMENTS

| | | | |
|---|---|---|---|
| CA | 2181879 | C | 4/2002 |
| CA | 2793083 | C | 9/2011 |
| CN | 1136350 | C | 1/2004 |
| CN | 1187017 | C | 2/2005 |
| CN | 201261837 | Y | 6/2009 |
| CN | 106544814 | A | 3/2017 |
| CN | 105466715 | A | 4/2018 |
| DE | 60126219 | T2 | 11/2007 |
| EP | 1505193 | A2 | 2/2005 |
| EP | 1580313 | B1 | 9/2005 |
| EP | 2382908 | A1 | 11/2011 |
| JP | H10295986 | A | 11/1998 |
| JP | 3297073 | B2 | 7/2002 |
| KR | 19990006535 | A | 1/1999 |
| KR | 100220275 | B1 | 9/1999 |
| KR | 100924445 | B1 | 11/2009 |
| KR | 100936965 | B1 | 1/2010 |
| WO | WO2019154297 | A1 | 8/2019 |

* cited by examiner

SYSTEM AND METHOD FOR DETERMINING DRY LOAD WEIGHT WITHIN A WASHING MACHINE APPLIANCE

FIELD OF THE INVENTION

The present subject matter relates generally to washing machine appliances, or more specifically, to systems and methods for determining dry load weight within a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Notably, it is frequently desirable to determine the dry load size or weight of a load of clothes within the washing machine appliance, e.g., in order to optimize water usage, agitation profile selection, and other wash parameters. In addition, the spin speed of the basket may frequently need to be limited based on dry load weight, e.g., due to the allowed system stresses and operating dynamics. However, conventional dry load weight detection methods are complex, time-consuming, and require costly sensors. In addition, such systems and methods suffer from inaccurate measurements, resulting in compromised wash performance and consumer dissatisfaction.

Accordingly, a washing machine appliance with features for improved dry load weight detection would be desirable. More specifically, a system and method for monitoring dry load weight without complex sensors or algorithms would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a wash tub positioned within a cabinet and defining a wash chamber, a wash basket rotatably mounted within the wash tub and being configured for receiving of a load of articles for washing, and a motor operably coupled to the wash basket for selectively rotating the wash basket. A controller is operably coupled to the motor and is configured for accelerating the wash basket to a predetermined speed during an acceleration period, obtaining an acceleration power of the motor during the acceleration period, maintaining rotation of the wash basket at the predetermined speed during a steady state period, obtaining a steady state power of the motor during the steady state period, and determining a dry load weight based on a power drop between the acceleration power and the steady state power.

In accordance with another exemplary embodiment of the present disclosure, a method of operating a washing machine appliance is provided. The washing machine appliance includes a wash basket rotatably mounted within a wash tub and a motor operably coupled to the wash basket for selectively rotating the wash basket. The method includes accelerating the wash basket to a predetermined speed during an acceleration period, obtaining an acceleration power of the motor during the acceleration period, maintaining rotation of the wash basket at the predetermined speed during a steady state period, obtaining a steady state power of the motor during the steady state period, and determining a dry load weight based on a power drop between the acceleration power and the steady state power.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
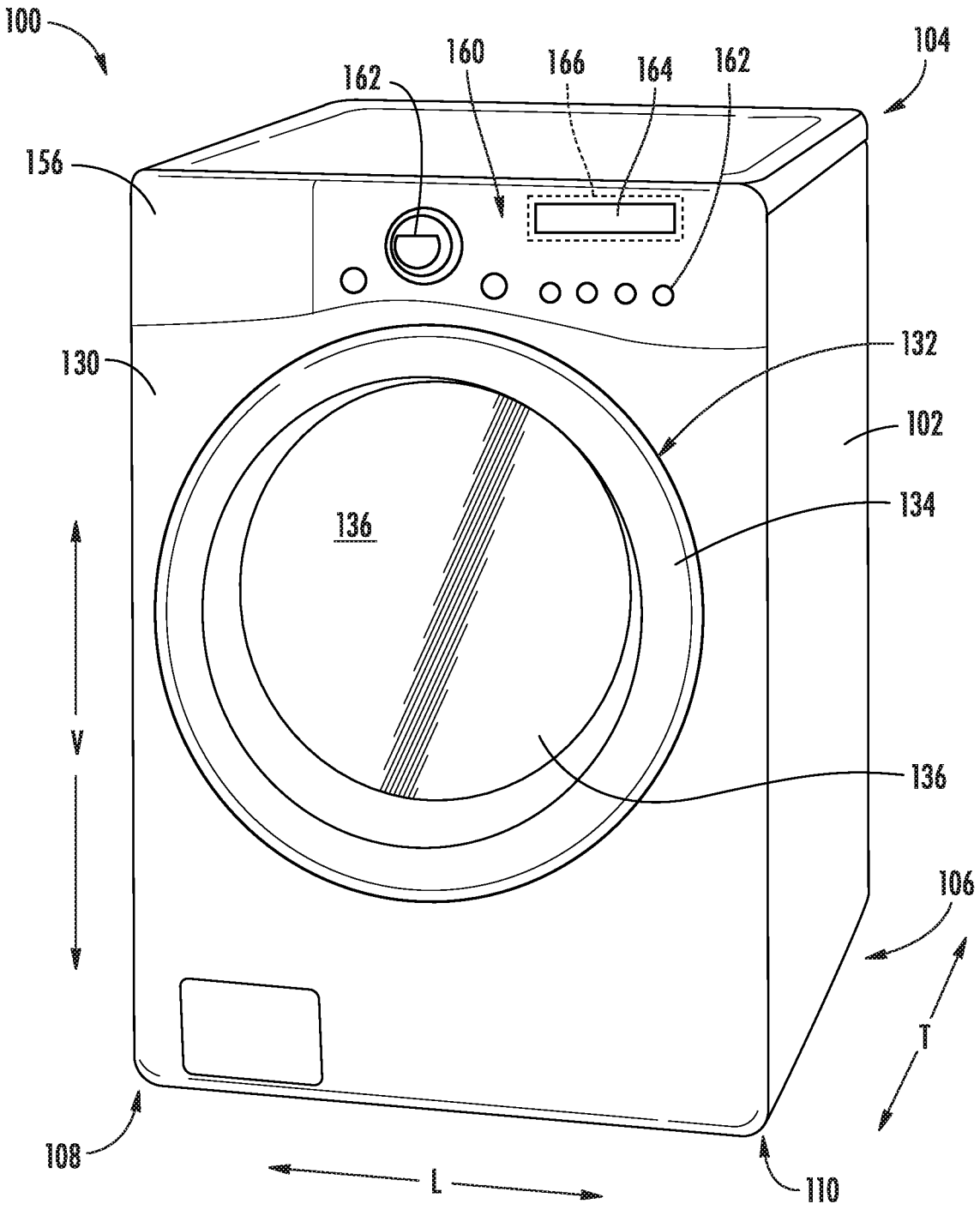
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
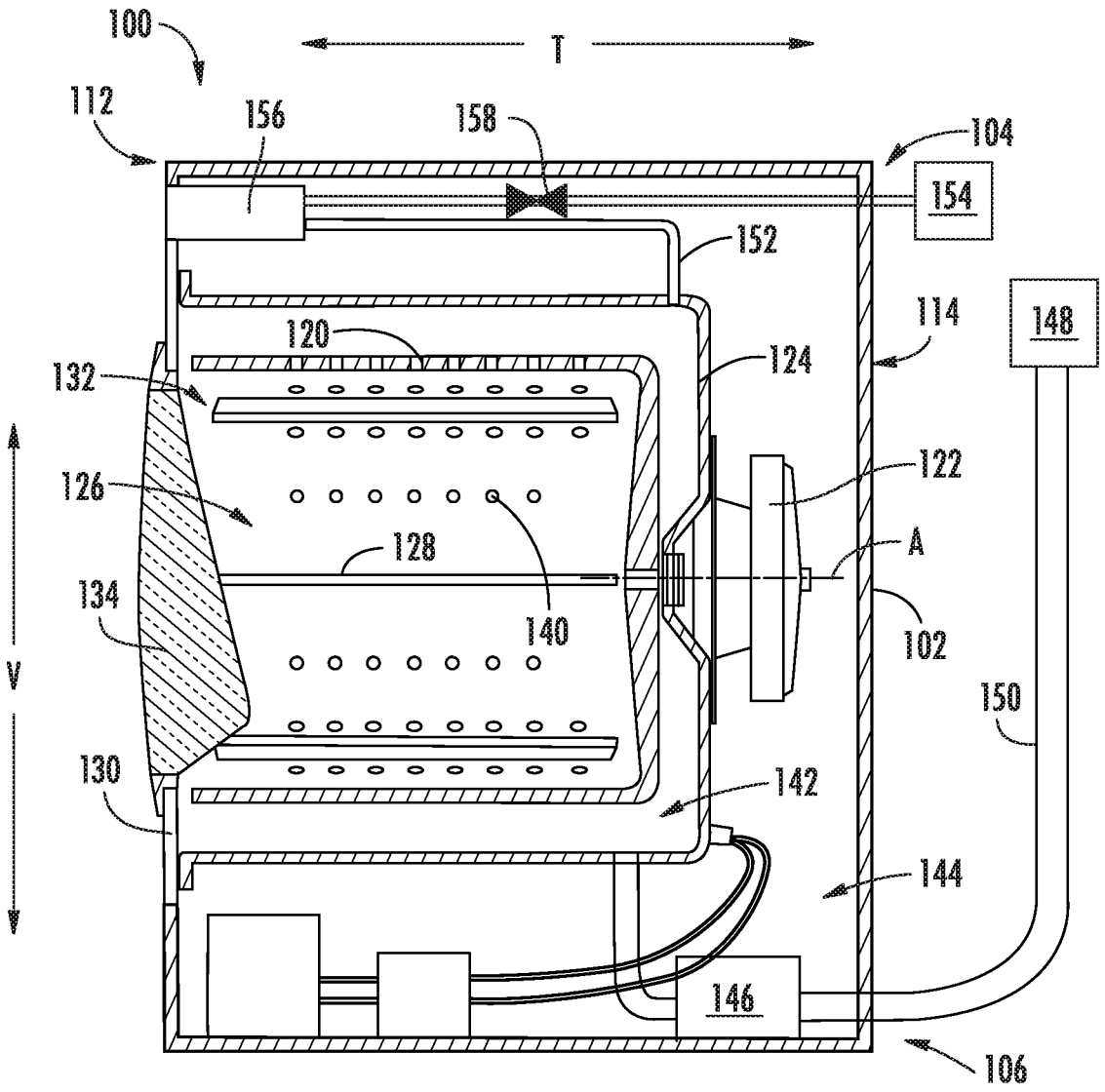
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive.

In addition, a water supply valve or control valve 158 may provide a flow of water from a water supply source (such as a municipal water supply 154) into detergent dispenser 156 and into wash tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 152 and or detergent drawer 156. One or more valves (e.g., control valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 3:
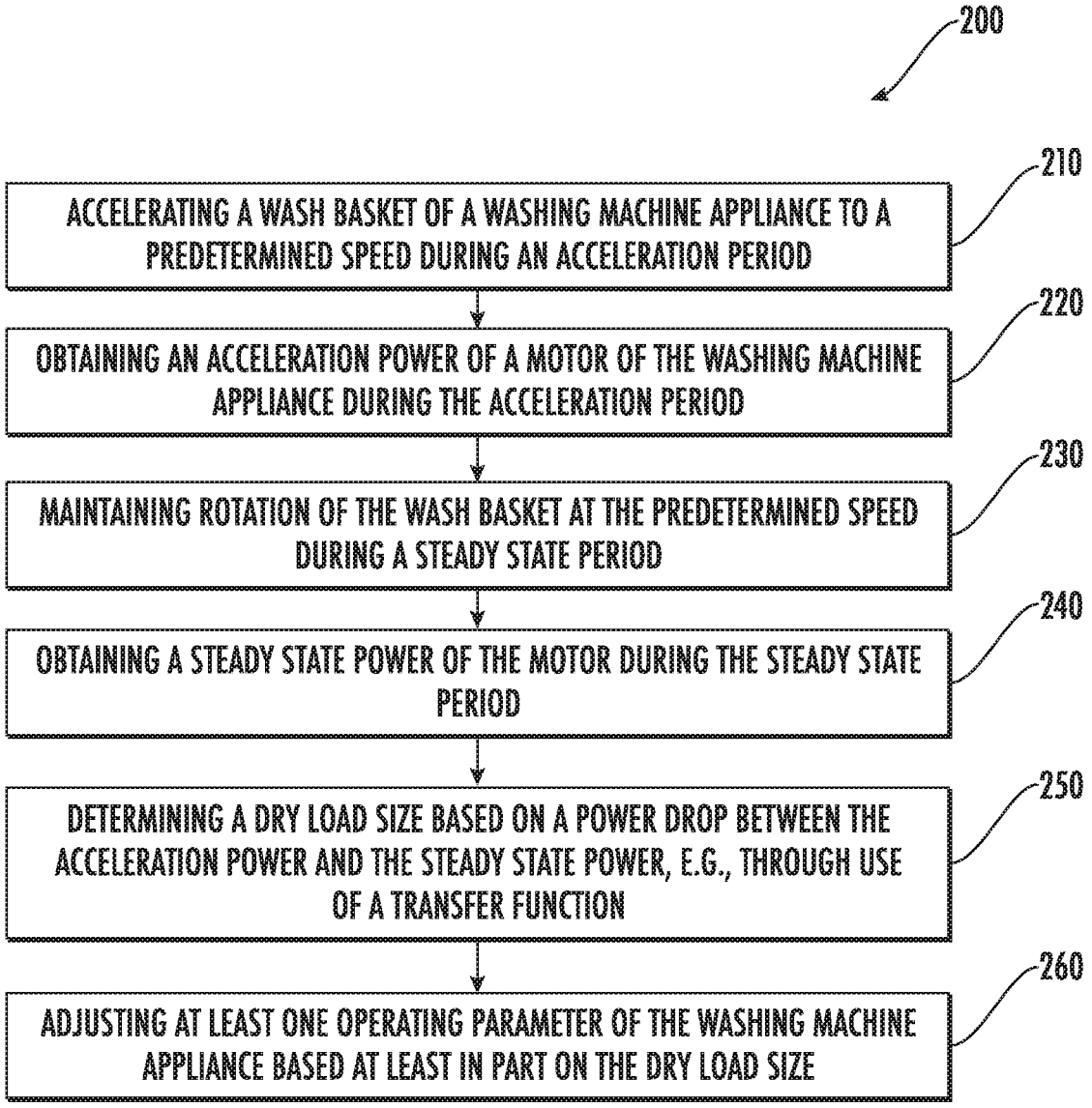
FIG. 3 illustrates a method for determining a dry load weight in a washing machine appliance in accordance with one embodiment of the present disclosure.
Figure 4:
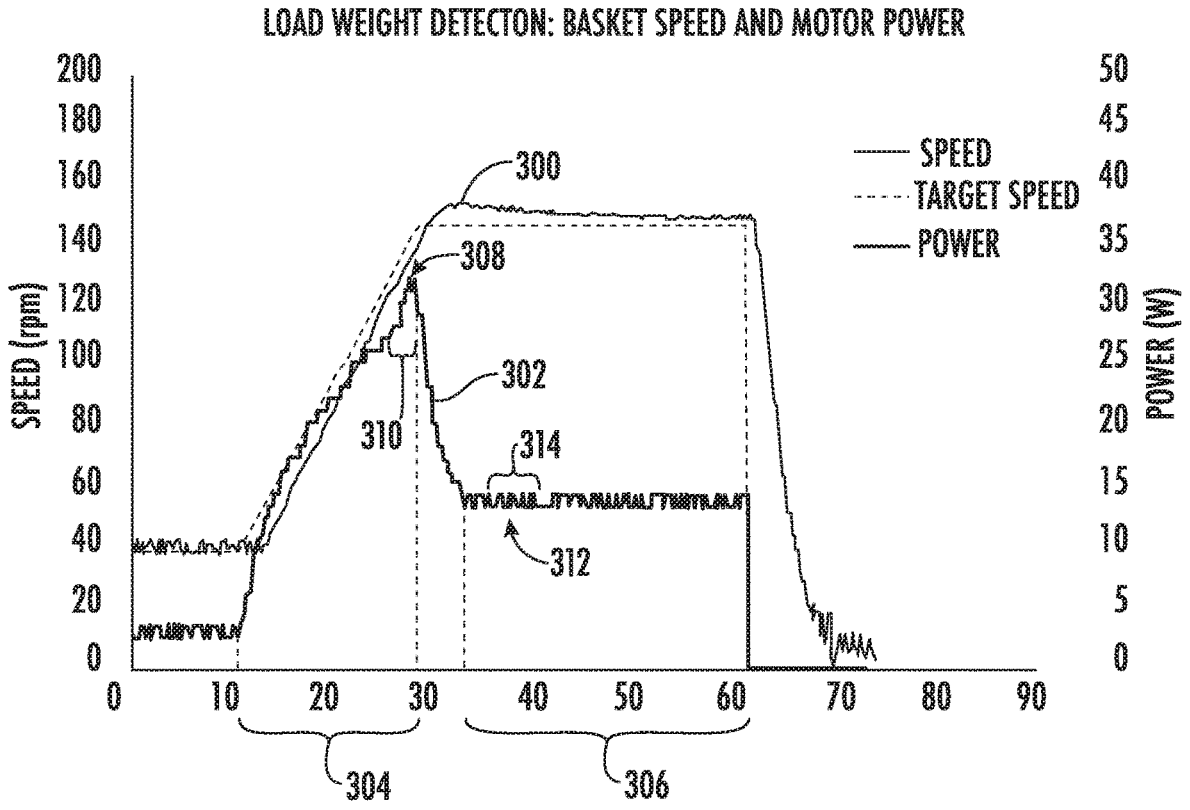
FIG. 4 provides an exemplary plot of a wash basket speed and a motor power over a typically load weight detection cycle according to an exemplary embodiment of the present subject matter.

Referring generally to FIGS. 3 and 4, a method of determining a dry load size or weight during a load weight detection cycle and a plot of such a load weight detection cycle, respectively, are provided. For example, referring briefly to FIG. 4, a plot of the basket speed (e.g., in revolutions per minute, identified by reference numeral 300) and the motor power (e.g., in Watts, identified by reference numeral 302) over time during a load weight detection cycle is provided according to an exemplary embodiment of the present subject matter. As shown, method 200 may be a part of a dry load weight or load score detection cycle performed before a wash cycle for each new load of clothes. The load weight detection cycle generally includes a sequence of spin operations and corresponding measurements of the wash basket speed and motor power, as described in detail below.

Referring again to FIG. 3, method 200 includes, at step 210, accelerating a wash basket of a washing machine appliance to a predetermined speed during an acceleration period (e.g., as identified by reference numeral 304 in FIG. 4). Specifically, according to the illustrated embodiment, motor 122 is regulated to accelerate wash basket 120 at a predetermined acceleration rate during the acceleration period, though other suitable acceleration profiles may be used according to alternative embodiments. In this regard, continuing the example from above, controller 166 may operate motor 122 to spin or rotate wash basket 120 after a new load of clothes has been added, and the load weight may be approximated based at least in part on the motor power required during the acceleration period.

Specifically, aspects of the present subject matter relate to approximating a load score or a dry load weight of the new load of clothes based at least in part on the motor power required to rotate wash basket 120 during the acceleration period 304 and a subsequent steady state period 306 (described below). Although exemplary systems and methods for making such measurements and implementing such spin profiles are described herein, it should be appreciated that variations and modifications may be made to washing machine appliance, its operation, and associated sensors and methods for detecting various operating parameters while remaining within the scope of the present subject matter.

For example, step 220 may include obtaining an acceleration power of a motor of the washing machine appliance during the acceleration period. In this manner, controller 166 may monitor the power required by motor 122 to drive wash basket 120 during all or part of the acceleration period 304. Although the present subject matter describes monitoring only motor power, it should be appreciated that according to alternative embodiments, any other suitable acceleration parameters that might be useful for determining a load score or size may be monitored. For example, other acceleration parameters that might be measured include basket speeds, motor voltage, currents, etc.

As explained in more detail below, aspects of the present subject matter are directed to determining a power drop between the amount of power required to accelerate the wash basket to a particular basket speed and the amount of power required to maintain the basket speed. According to exemplary embodiments, it may be desirable to determine the peak acceleration during the acceleration period 304. In this regard, according to an exemplary embodiment, obtaining the acceleration power may include obtaining a maximum power exerted by the motor during the acceleration period 304. In this regard, for example, controller 166 may monitor the motor power curve 302 and may use any suitable method for determining the maximum power (e.g., as identified by reference numeral 308 in FIG. 4).

According to alternative embodiments, obtaining the acceleration power may include measuring the power exerted by motor 122 during an acceleration measurement period that precedes the end of the acceleration period 304. Specifically, as shown for example in FIG. 4, the acceleration measurement period is identified by reference numeral 310. Controller 166 may continuously or periodically take power samples during this acceleration measurement period 310, and these samples may be averaged to determine the acceleration power. These measurements may be taken at a fixed rate or at a variable rate throughout the entire acceleration period 304 or during a subset of the acceleration period 304, e.g., such as the acceleration measurement period 310. It should be appreciated that the acceleration measurement period 310 may have any suitable duration and may include any suitable number of measurements or power samples. For example, according to exemplary embodiments, the acceleration measurement period 310 may be between about 0.1 and 10 seconds, between about 0.5 and 7 seconds, between about 1 and 5 seconds, or about 3 seconds in duration.

It should be appreciated that any suitable measurement method, sampling rate, or measured variables may be used as a proxy for motor power. For example, according to an exemplary embodiment, motor current and/or voltage is measured and used as a proxy for motor power. In addition, motor voltage may be approximated using system or appliance voltage. Furthermore, basket speeds may be determined by measuring a motor frequency, a back electromotive force (EMF) on the motor, or a motor shaft speed (e.g., using a tachometer). It should be appreciated that other systems and methods for monitoring motor power and/or basket speeds may be used while remaining within the scope of the present subject matter.

Step 230 includes maintaining rotation of the wash basket at the predetermined speed during a steady state period (e.g., as identified by reference numeral 306 in FIG. 4). According to the illustrated embodiment shown in FIG. 4, the steady state period 306 occurs after the acceleration period 304. In general, during the steady state period 306, the motor 122 maintains the rotation of the wash basket at a predetermined speed. In this regard, for example, the acceleration period 304 may continue until the wash basket is spinning at a predetermined speed, e.g., such as 150 revolutions per minute (RPM), after which the steady state period 306 commences to maintain that speed.

Step 240 includes obtaining a steady state power of the motor during the steady state period 306. In this regard, the steady state motor power may be an average power (e.g., as identified by reference numeral 312 in FIG. 4). It should be appreciated that motor power during the steady state period 306 may be measured in a manner similar to that described above with respect to the acceleration period 304. According to exemplary embodiments, the average power 312 may be measured over the entire steady state period 306 or a subset of the steady state period 306. For example, obtaining the steady state power may include measuring power exerted by motor 122 during a steady state measurement period 314 that begins after the wash basket 122 has stabilized at the predetermined speed. In this regard, controller 166 may monitor the motor power over steady state measurement period 314 and may take a statistical average at step 240. Alternatively, controller 166 may take a single measurement that may be used as the statistical average. Other methods of sampling and statistically determining the motor power over the steady state period 306 or the steady state measurement period 314 may be used while remaining within the scope of the present subject matter.

Method 200 further includes, at step 250, determining a dry load weight based on a power drop between the acceleration power and the steady state power. For example, according to one exemplary embodiment, the power drop may be equivalent to the acceleration power 308 determined at step 220 minus the steady state power 312 determined at step 240. This power drop may be passed into a transfer function, such as a weighted transfer function with empirically determined constants or scaling values to determine an accurate dry load size or weight, e.g., in kilograms. More specifically, according to an exemplary embodiment, determining the dry load weight may include using the following equation:

$$M=c_m(P_{acc}-P_{ss})-C$$

where: M=dry load weight or mass;

$P_{acc}$=the acceleration power during the acceleration period;

$P_{ss}$=the steady state power during the steady state period;

$c_m$=a coefficient correlating load mass and motor power; and

C=a constant.

It should be appreciated that the equation provided above may vary while remaining within the scope of the present subject matter. For example, the number of samples taken, the frequency of samples taken, the variables measured, and other scaling factors may vary according to alternative embodiments. Such variations shall remain within the scope of the present subject matter. Furthermore, it should be appreciated that method 200 for determining the dry load weight is only one exemplary method used for the purpose of explaining aspects of the present subject matter. For example, the weighting values $c_m$ through C may vary depending on the specific appliance, the appliance model, or any other suitable factors. These scaling factors may be determined empirically, based on models, or using any other suitable calculations. Such variations shall remain within the scope of the present subject matter.

Notably, as explained above, the load weight or load score may affect the washing performance of washing machine appliance 100. Therefore, method 200 may further include, at step 260, adjusting at least one operating parameter of the washing machine appliance based at least in part on the dry load weight. As used herein, an "operating parameter" of washing machine appliance 100 is any cycle setting, operating time, component setting, spin speed, part configuration, or other operating characteristic that may affect the performance of washing machine appliance 100. Thus, references to operating parameter adjustments or "adjusting at least one operating parameter" are intended to refer to control actions intended to improve system performance based on the dry load weight or other system parameters. For example, adjusting an operating parameter may include adjusting an additive dispense amount, adjusting an agitation profile, adjusting a water level, limiting a spin speed of wash basket 120, etc. Other operating parameter adjustments are possible and within the scope of the present subject matter.

FIG. 3 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a wash tub positioned within a cabinet and defining a wash chamber;

a wash basket rotatably mounted within the wash tub and being configured for receiving of a load of articles for washing;

a motor operably coupled to the wash basket for selectively rotating the wash basket; and a controller operably coupled to the motor, the controller being configured for:

accelerating the wash basket to a predetermined speed during an acceleration period;

obtaining an acceleration power of the motor during an acceleration measurement period limited to the last quarter of the acceleration period;

maintaining rotation of the wash basket at the predetermined speed during a steady state period;

obtaining a steady state power of the motor during the steady state period; and determining a dry load weight based on a power drop between the acceleration power and the steady state power.

2. The washing machine appliance of claim 1, wherein accelerating the wash basket comprises:

accelerating the wash basket at a predetermined acceleration rate.

3. The washing machine appliance of claim 1, wherein obtaining the acceleration power comprises:

obtaining a maximum power exerted by the motor during the acceleration period.

4. The washing machine appliance of claim 1, wherein the acceleration measurement period is between 1 and 5 seconds.

5. The washing machine appliance of claim 1, wherein obtaining the steady state power comprises:

measuring power exerted by the motor during a steady state measurement period that begins after the wash basket has stabilized at the predetermined speed.

6. The washing machine appliance of claim 5, wherein obtaining the steady state power comprises:

averaging the power exerted by the motor during the steady state measurement period.

7. The washing machine appliance of claim 1, wherein determining the dry load weight comprises:

determining the dry load weight using the power drop and a transfer function.

8. The washing machine appliance of claim 7, wherein the transfer function comprises:

$$M=c_m(P_{acc}-P_{ss})-C$$

where: M=dry load weight or mass;

$P_{acc}$=the acceleration power during the acceleration period;

$P_{ss}$=the steady state power during the steady state period;

$c_m$=a coefficient correlating load mass and motor power; and

C=a constant.

9. The washing machine appliance of claim 1, wherein a motor current is measured as a proxy for the motor power.

10. The washing machine appliance of claim 1, wherein the controller is further configured for:

adjusting at least one operating parameter of the washing machine appliance based at least in part on the dry load weight.

11. The washing machine appliance of claim 10, wherein adjusting the at least one operating parameter comprises:

adjusting an additive dispense amount, adjusting an agitation time or profile, adjusting a water level, or limiting a spin speed.

12. A method of operating a washing machine appliance, the washing machine appliance comprising a wash basket rotatably mounted within a wash tub and a motor operably coupled to the wash basket for selectively rotating the wash basket, the method comprising:

accelerating the wash basket to a predetermined speed during an acceleration period;

obtaining an acceleration power of the motor during an acceleration measurement period limited to the last quarter of the acceleration period;

maintaining rotation of the wash basket at the predetermined speed during a steady state period;

obtaining a steady state power of the motor during the steady state period; and determining a dry load weight based on a power drop between the acceleration power and the steady state power.

13. The method of claim 12, wherein obtaining the acceleration power comprises:

obtaining a maximum power exerted by the motor during the acceleration period.

14. The method of claim 12, wherein obtaining the steady state power comprises:

measuring power exerted by the motor during a steady state measurement period that begins after the wash basket has stabilized at the predetermined speed.

15. The method of claim 14, wherein obtaining the steady state power comprises:

averaging the power exerted by the motor during the steady state measurement period.

16. The method of claim 12, wherein determining the dry load weight comprises:

determining the dry load weight using the power drop and a transfer function.

17. The method of claim 16, wherein the transfer function comprises:

$$M=c_m(P_{acc}-P_{ss})-C$$

where: M=dry load weight or mass;

$P_{acc}$=the acceleration power during the acceleration period;

$P_{ss}$=the steady state power during the steady state period;

$c_m$=a coefficient correlating load mass and motor power; and

C=a constant.

18. The method of claim 12, wherein the controller is further configured for:

adjusting at least one operating parameter of the washing machine appliance based at least in part on the dry load weight.

* * * * *